US005935346A

United States Patent [19]

Couderchon et al.

[11] Patent Number: 5,935,346

[45] Date of Patent: Aug. 10, 1999

[54] PROCESS FOR THE HEAT TREATMENT, IN A MAGNETIC FIELD, OF A COMPONENT MADE OF A SOFT MAGNETIC MATERIAL

[75] Inventors: Georges Couderchon; Philippe Verin, both of Sauvigny-lès-Bois, France

[73] Assignee: Mecagis, Puteaux, France

[21] Appl. No.: 09/081,940

[22] Filed: May 21, 1998

[30] Foreign Application Priority Data

Jun. 4, 1997 [FR] France ..... 97 06849

[51] Int. Cl.[6] ..... H01F 1/14; C21D 1/04

[52] U.S. Cl. ..... 148/108

[58] Field of Search ..... 148/108

[56] References Cited

U.S. PATENT DOCUMENTS

| | | | |
|---|---|---|---|
| 3,887,401 | 6/1975 | Hetzel | 148/121 |
| 4,379,004 | 4/1983 | Makino et al. | 148/108 |
| 4,639,278 | 1/1987 | Makino et al. | 148/108 |
| 4,816,965 | 3/1989 | Drits | 361/267 |
| 4,873,605 | 10/1989 | Drits et al. | 361/143 |
| 4,950,337 | 8/1990 | Li et al. . | |
| 5,503,686 | 4/1996 | Okamura et al. | 148/108 |

FOREIGN PATENT DOCUMENTS

| | | |
|---|---|---|
| 28 16 173 | 10/1979 | Germany . |
| 63-011654 | 1/1988 | Japan . |
| 63-255371 | 10/1988 | Japan . |

OTHER PUBLICATIONS

Y. Yoshizawa, et al.; Effects Of Magnetic Field Annealing On Magnetic Properties In Ultrafine Crystalline Fe–Cu–N-b–Si–B Alloys; Sep. 1, 1989; vol. 25, No. 5, pp. 3324–3326.

*Primary Examiner*—John Sheehan

*Attorney, Agent, or Firm*—Oblon, Spivak, McClelland, Maier & Neustadt, P.C.

[57] ABSTRACT

Process for the heat treatment, in a magnetic field, of a magnetic component made of a low-anisotropy soft magnetic material such as, for example, a 15/80/5 FeNiMo alloy, an amorphous Co-based alloy or a nanocrystalline FeSi-CuNbB alloy, in which the magnetic component is annealed at a temperature below the Curie point of the magnetic material and, during the annealing, the magnetic component is subjected to a DC or AC, unidirectional, longitudinal or transverse magnetic field, in which process the magnetic field is applied in the form of a succession of pulses each comprising a first part during which the intensity of the magnetic field reaches a maximum value and a second part during which the intensity of the magnetic field has a minimum value.

20 Claims, 1 Drawing Sheet

PROCESS FOR THE HEAT TREATMENT, IN A MAGNETIC FIELD, OF A COMPONENT MADE OF A SOFT MAGNETIC MATERIAL

FIELD OF THE INVENTION

The present invention relates to a process for the heat treatment, in a magnetic field, of a magnetic component, for example of a magnetic core for a residual current device. Preferably, the component comprise a soft magnetic alloy such as a 15/80/5 FeNiMo alloy, an amorphous Co-based alloy or a nanocrystalline FeSiCuNbB alloy.

BACKGROUND OF THE INVENTION

For applications in electrical engineering, such as measurement transformers or supply transformers, magnetic cores are used which contain of a magnetic material chosen for its magnetic properties, such as its magnetic permeability or its losses. For these applications, the shape of the hysteresis loop is not essential. On the other hand, for many applications handling low-amplitude electrical signals, for example residual current devices, switching-mode power supplies or transformers for connecting to digital telephone networks, the shape of the hysteresis loop is of paramount importance. The shape of the hysteresis loop is characterized, in particular, by the $B_r/B_m$ ratio—the ratio of the remanent induction to the maximum induction. When $B_r/B_m$ is greater than approximately 0.9, the hysteresis loop is called "rectangular". When the $B_r/B_m$ ratio is less than approximately 0.5, the hysteresis loop is called "flat". Materials having a rectangular hysteresis loop are used, for example, to produce the magnetic cores of magnetic amplifiers or of control stages for switching-mode power supplies. Materials having a flat hysteresis loop are used, in particular, for producing the magnetic cores of residual current devices, electrical filters or DC isolating transformers.

In order to manufacture magnetic components from a soft magnetic material having a precisely shaped hysteresis loop, either rectangular or flat, soft magnetic alloys having low anisotropy (anisotropy coefficients of less than 5000 ergs/cm$^3$ and preferably less than 1000 ergs/cm$^3$) are used, such as 15/80/5 FeNiMo alloys, amorphous Co-based alloys or nanocrystalline FeSiCuNbB-type alloys, and the magnetic components are annealed in an intense magnetic field. The annealing is carried out at a temperature below the Curie point of the alloy. The magnetic field is longitudinal, i.e. parallel to the direction in which the magnetic properties will be measured, when it is desired to obtain a rectangular hysteresis loop. It is transverse, i.e. perpendicular to the direction in which the magnetic properties will be measured, when it is desired to obtain a flat hysteresis loop. The magnetic field is applied throughout the duration of the treatment, and it is constant. The temperature and duration of treatment are the two parameters which have an impact on the result of the heat treatment. These treatments, when they are of long duration (from one hour to a few hours), make it possible to obtain, with great reliability, either very rectangular ($B_r/B_m>0.9$) hysteresis loops or very flat ($B_r/B_m<0.2$) hysteresis loops. However, they do not make it possible to obtain with sufficient reliability hysteresis loops having an intermediate shape ($0.3<B_r/B_m<0.9$) which are very useful for some applications. This is because, in order to obtain such hysteresis loops, it is necessary to carry out short annealing operations, but then the results are much too random, both in terms of rectangularity and permeability, to be able to envisage an industrial application. This is because both these parameters must be able to be controlled simultaneously.

OBJECTS OF THE INVENTION

One object of the present invention is to remedy this drawback, by providing a means for obtaining, in a reproducible manner, magnetic components made of a soft magnetic alloy having hysteresis loops intermediate between the very rectangular hysteresis loops and the very flat hysteresis loops, i.e. loops characterized by a $B_r/B_m$ ratio of between 0.3 and 0.9.

SUMMARY OF THE INVENTION

For this purpose, the subject of the invention is a process for the heat treatment, in a magnetic field, of a magnetic component comprising, consisting essentially of, or consisting of a soft magnetic material, preferably having an anisotropy coefficient of less than 5000 ergs/cm$^3$ more preferably less than 1000 ergs/cm$^3$, such as, for example, a 15/80/5 FeNiMo alloy, an amorphous Co-based alloy or a nanocrystalline FeSiCuNbB alloy, in which the magnetic component is annealed at a temperature below the Curie point of the magnetic material and, during the annealing, the magnetic component is subjected to an AC or DC, longitudinal or transverse magnetic field applied in the form of a succession of pulses each comprising a first part during which the intensity of the magnetic field reaches a maximum value and a second part during which the intensity of the magnetic field has a minimum value. This minimum value is preferably less than 10% of the maximum value of the field corresponding to the largest pulse to which the magnetic component is subjected.

The maximum intensities of the magnetic fields of two successive pulses may be substantially (±10%) equal or substantially (≧10%) different. In particular, for any pair of two successive pulses, the maximum intensity of the magnetic field of the second pulse may be less than the maximum intensity of the magnetic field of the first pulse, and the maxima may continue to decrease throughout the treatment. The maximum intensity of the magnetic field of the final pulse generated may then be less than 25% of the maximum intensity of the magnetic field of the first pulse generated. The relative intensities of successive pulses may also increase during treatment, stay the same or substantially (±10%) the same, or vary in any way.

Preferably, for each pulse, the minimum intensity of the magnetic field is zero.

Also preferably, each pulse has a total duration of less than 30 minutes, the duration of the period during which the magnetic field has a maximum intensity being less than 15 minutes.

DETAILED DESCRIPTION OF THE INVENTION

Figure 1:
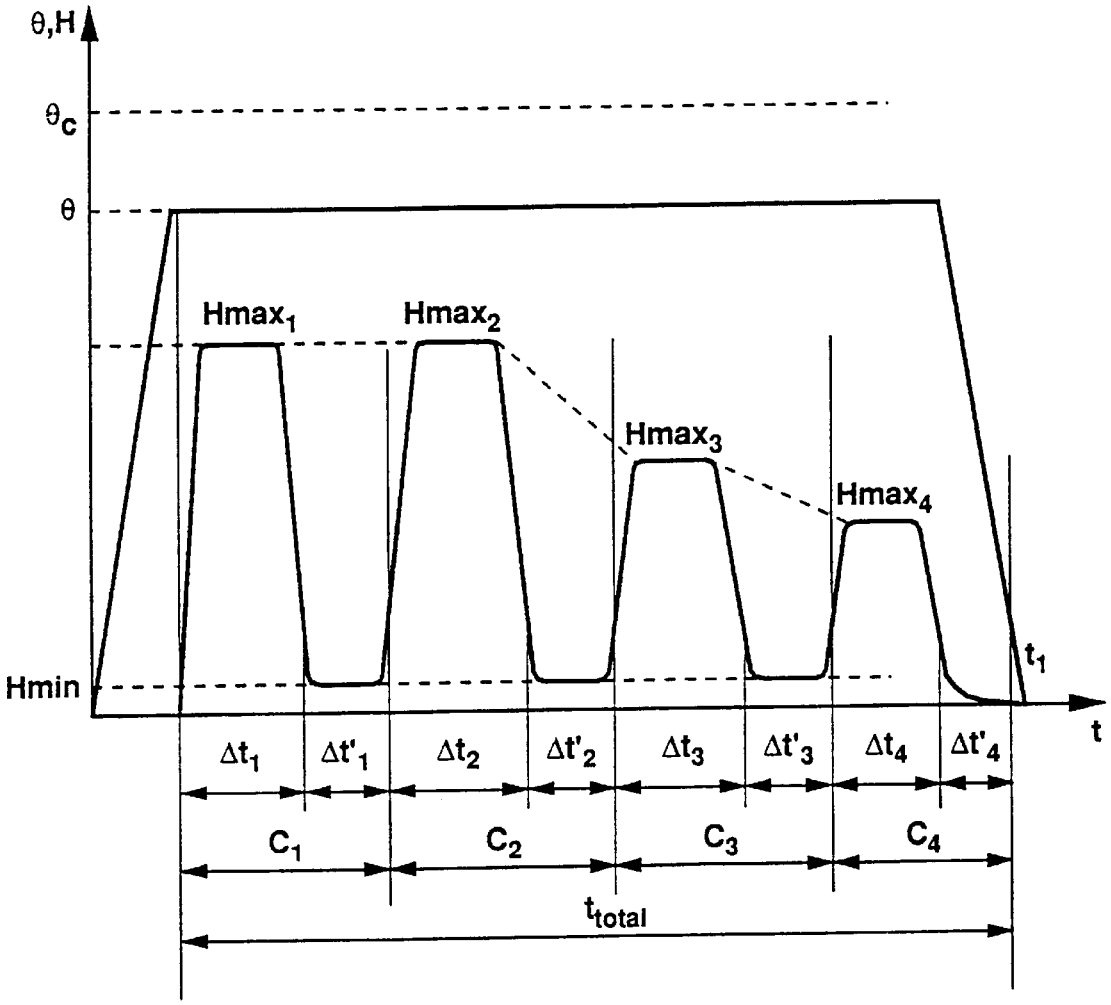

The invention will now be described in greater detail with regard to the single appended figure which shows the variation over time of the temperature and of the magnetic field applied during the heat treatment of a magnetic component made of a soft magnetic alloy. The invention will also be illustrated by examples.

The heat treatment according to the invention, which is applied to any magnetic component containing a soft magnetic alloy having a very low anisotropy, comprises annealing in a magnetic field at a temperature below the Curie point of the soft magnetic alloy, in which the magnetic field is applied discontinuously. This heat treatment in a magnetic field is carried out in, e.g., a furnace, known per se, for heat treatment in a unidirectional magnetic field. When, for example, the magnetic component is a toroidal magnetic core consisting of a ribbon made of a soft magnetic alloy wound so as to form a torus of rectangular cross-section, the magnetic field is generated either by an electrical conductor through which a DC or AC electrical current flows, over which the torus is slipped, or by a coil whose axis is parallel to the axis of revolution of the torus and which surrounds the torus. In the first case, the magnetic field is longitudinal, i.e. parallel to the longitudinal axis of the ribbon of soft magnetic alloy. In the second case, the magnetic field is transverse, i.e. parallel to the surface of the ribbon, but perpendicular to the longitudinal axis of it.

Preferably, the annealing temperature is greater than 0.5 times the Curie temperature expressed in degrees centigrade.

As shown in FIG. 1, the heat treatment comprises:

in the case of the temperature, a temperature hold at the treatment temperature θ, below the Curie point θc, between the treatment-start time $t_0$ and the treatment-finish time $t_1$;

in the case of the magnetic field, a succession of pulses $C_1$, $C_2$, $C_3$ and $C_4$.

Each pulse has a first part of duration Δt ($\Delta t_1$ for $C_1$, $\Delta t_2$ for $C_2$, etc.) during which the intensity of the magnetic field has a maximum value Hmax ($Hmax_1$ for $C_1$, $Hmax_2$ for $C_2$, etc.) and a second part of duration Δt' ($\Delta t'_1$ for $C_1$, $\Delta t'_2$ for $C_2$, etc.) during which the intensity of the magnetic field has a minimum value Hmin ($Hmin_1$ for $C_1$, $Hmin_2$ for $C_2$, etc.).

When the magnetic field is continuous, Hmax represents the intensity of the magnetic field. When the magnetic field is alternating, Hmax represents the peak intensity of the magnetic field (the maximum intensity reached at each period of alternation).

The pulses as shown are rectangular. However, the pulses may, for example, be of the trapezoidal type or of the triangular type, the intensity of the magnetic field decreasing in a regular fashion in the course of the part of the pulse corresponding to the intense magnetic field.

In the example shown, the maximum values of the magnetic field $Hmax_1$ and $Hmax_2$, corresponding to the two successive pulses $C_1$ and $C_2$, are equal. However, $Hmax_3$ is smaller than $Hmax_2$ and higher than $Hmax_4$. In fact, the variation in the successive maximum values of the magnetic field may be chosen as required. In particular, these successive values may decrease throughout the treatment, starting from a value allowing saturation of the tori during the treatment (this value depends not only on the nature of the material of which the tori are composed but also on the dimensions of the tori) in order to reach, at the end of the treatment, a value of less than 25% of the initial value.

The minimum values of the magnetic field Hmin are, in general, approximately zero and, in all cases, must remain less than 10% of the maximum value reached by the magnetic field during the treatment.

In general, the Δt values are of the order of 5 minutes and preferably should remain less than 15 minutes. They are not necessarily equal from one pulse to another. The durations Δt' are, in general, of the order of 5 minutes and preferably should remain less than 30 minutes.

The number of pulses may be chosen as required depending on the result to be obtained, and also depending on the total duration of the treatment which preferably is greater than 10 minutes and which may last several hours. In all circumstances, the number of pulses must be greater than 2.

As a variant, some of the pulses are generated in a longitudinal field, the others being generated in a transverse field.

EXAMPLE

By way of example, with a ribbon made of the alloy $Fe_{73.5}Si_{13.5}Nb_3Cu_1B_9$, magnetic cores were manufactured in the form of tori having an external diameter of 26 mm, an internal diameter of 16 mm and a thickness of 10 mm. These magnetic cores were firstly subjected to a heat treatment consisting of holding the temperature at 530° C. for 1 hour so as to give them a nanocrystalline structure, and then subjected, in a magnetic field, to various annealing treatments according to the invention. The various treatments were differentiated by the hold temperature, by the proportion of the hold time during which the magnetic field was applied and by the direction of the magnetic field. In all cases, the temperature-hold time was 1 hour and the magnetic field was applied in the form of rectangular pulses during which the maximum intensity of the magnetic field was sufficient to saturate the tori for a few minutes. The shapes of the hysteresis loops obtained, characterized by the $B_r/B_m$ ratio, were:

| | Transverse field | | Longitudinal field | |
|---|---|---|---|---|
| Temperature | 25% of the time | 95% of the time | 25% of the time | 95% of the time |
| 250° C. | 0.55 | 0.35 | 0.65 | 0.75 |
| 300° C. | 0.40 | 0.25 | 0.70 | 0.80 |
| 350° C. | 0.25 | 0.15 | 0.80 | 0.85 |
| 400° C. | 0.15 | 0.05 | 0.85 | 0.95 |

In this table, it may be seen, for example, that, for a treatment in a transverse field applied for 25% of the time and an annealing temperature of 250° C., the $B_r/B_m$ ratio was 0.35. In fact, these values were obtained to within ±0.02. In addition, the maximum magnetic permeabilities at 50 Hz were systematically at least 25% greater than the maximum magnetic permeabilities at 50 Hz obtained by heat treatments in a continuous magnetic field according to the prior art.

More specifically, in the case of annealing at 400 20 C. in a transverse field applied in the form of pulses, the intense field being applied for 25% of the temperature-hold time, a $B_r/B_m$ ratio of between 0.08 and 0.12 and an impedance magnetic permeability at 50 Hz,$\mu_{max}$, of between 180,000 and 220,000 were obtained.

By way of comparison, heat treatments in a field according to the prior art were carried out, that is to say heat treatments during which the magnetic field is kept constant throughout the temperature hold. These treatments consisted of annealing at 350° C. in a perpendicular field. They resulted in $B_1/B_m$ values of between 0.12 and 0.31, i.e. a scatter which is five times greater than in the previous example. The permeability $\mu_{max}$ values were between 180,000 and 220,000.

French patent application 97 06849 is incorporated herein by reference.

We claim:

1. A process for the heat treatment, in a magnetic field, of a magnetic component comprising a low-anisotropy soft magnetic material having an anisotropy coefficient of less than 5000 ergs/cm$^3$ wherein the magnetic component is annealed at a temperature below the Curie point of the magnetic material and, during the annealing, the magnetic component is subjected to a DC or AC, unidirectional, longitudinal or transverse magnetic field, and wherein the magnetic field is applied in the form of a succession of pulses each comprising a first part during which the intensity of the magnetic field reaches a maximum value and a second part during which the intensity of the magnetic field has a minimum value.

2. The process as claimed in claim 1, wherein, for at least two successive pulses, the maximum intensities of the magnetic fields are substantially equal.

3. The process as claimed in claim 1, wherein, for at least two successive pulses, the maximum intensities of the magnetic fields are substantially different.

4. The process as claimed in claim 3, wherein the maximum intensity of the magnetic field of the second pulse is less than the maximum intensity of the magnetic field of the first pulse.

5. The process as claimed in claim 4, wherein, for any pair of two successive pulses, the maximum intensity of the magnetic field of the second pulse is less than the maximum intensity of the magnetic field of the first pulse.

6. The process as claimed in claim 5, wherein the maximum intensity of the magnetic field of the final pulse generated is less than 25% of the maximum intensity of the magnetic field of the first pulse generated.

7. The process as claimed in claim 1, wherein, for at least one pulse, the minimum intensity of the magnetic field is less than 10% of the maximum intensity reached by the magnetic field during the treatment.

8. The process as claimed in claim 1, wherein at least one pulse has a total duration of less than 30 minutes.

9. The process as claimed in claim 8, wherein, for at least one pulse whose total duration is less than 30 minutes, the duration of the part during which the magnetic field has a maximum intensity is less than 15 minutes.

10. The process as claimed in any one of claim wherein the total duration of the heat treatment is greater than 10 minutes.

11. The process as claimed in claim 1, wherein said soft magnetic material is a 15/80/5 FeNiMo alloy.

12. The process as claimed in claim 1, wherein said soft magnetic material is an amorphous Co-based alloy.

13. The process as claimed in claim 1, wherein said soft magnetic material is a nano-crystalline FeSiCuNbB alloy.

14. The process as claimed in claim 2, wherein, for at least one pulse, the minimum intensity of the magnetic field is less than 10% of the maximum intensity reached by the magnetic field during the treatment.

15. The process as claimed in claim 3, wherein, for at least one pulse, the minimum intensity of the magnetic field is less than 10% of the maximum intensity reached by the magnetic field during the treatment.

16. The process as claimed in claim 4, wherein, for at least one pulse, the minimum intensity of the magnetic field is less than 10% of the maximum intensity reached by the magnetic field during the treatment.

17. The process as claimed in claim 2, wherein at least one pulse has a total duration of less than 30 minutes.

18. The process as claimed in claim 3, wherein at least one pulse has a total duration of less than 30 minutes.

19. The process as claimed in claim 4, wherein at least one pulse has a total duration of less than 30 minutes.

20. The process as claimed in claim 2, wherein the total duration of the heat treatment is greater than 10 minutes.

* * * * *